US008242920B1

(12) United States Patent
Mostowfi et al.

(10) Patent No.: US 8,242,920 B1
(45) Date of Patent: Aug. 14, 2012

(54) METHOD AND APPARATUS FOR LEAK DETECTION

(75) Inventors: Darius Mostowfi, San Carlos, CA (US); Brian Lamb, San Francisco, CA (US); Jackie Lai, Mountain View, CA (US); Andrew Butler, Palo Alto, CA (US)

(73) Assignee: D2M International Pty Ltd., Hong Kong (HK)

( * ) Notice: Subject to any disclaimer, the term of this patent is extended or adjusted under 35 U.S.C. 154(b) by 386 days.

(21) Appl. No.: 12/354,132

(22) Filed: Jan. 15, 2009

Related U.S. Application Data

(60) Provisional application No. 61/079,730, filed on Jul. 10, 2008, provisional application No. 61/091,589, filed on Aug. 25, 2008.

(51) Int. Cl.
*G08B 21/00* (2006.01)

(52) U.S. Cl. ..... 340/605; 4/415

(58) Field of Classification Search ..... 340/605; 4/415, 237; 73/306, 49.1
See application file for complete search history.

(56) References Cited

U.S. PATENT DOCUMENTS 6,006,605 A * 12/1999 Sulollari ..... 73/306
2006/0168717 A1 * 8/2006 Schuster et al. ..... 4/415

* cited by examiner

*Primary Examiner* — Shirley Lu
(74) *Attorney, Agent, or Firm* — Jeffrey Schox

(57) ABSTRACT

A leak detector is disclosed. The optical leak detector may include a sensor module for transmitting and receiving signals corresponding to the surface level of a monitored fluid and include leak detection logic for detecting a leak signature. The leak detection logic may be configured to determine if fluid contained in a tank is in a non-full state outside of a normal state and activate an alarm.

22 Claims, 9 Drawing Sheets

METHOD AND APPARATUS FOR LEAK DETECTION

CROSS-REFERENCE TO RELATED APPLICATIONS

This application claims priority to U.S. provisional applications 61/079,730, filed Jul. 10, 2008, and 61/091,589, filed Aug. 25, 2008.

FIELD OF THE DISCLOSURE

This invention relates to the detection of leaks, and more particularly to the detection of water leaks in toilets.

BACKGROUND OF THE INVENTION

By some estimates, approximately 50 percent of all households have some kind of plumbing leak. Many of these leaks are due to worn out flappers or faulty tank valves in toilets. Toilet leaks can result in hundreds or thousands of gallons of water wasted needlessly, resulting in a waste of natural resources and a higher water bill.

The most common toilet leaks can be very costly because toilets often represent the greatest water usage in the home. A leaky toilet can waste over 200 gallons of water per day. Left unfixed, a leaky toilet can waste over 73,000 gallons of water per year.

DETAILED DESCRIPTION

Most modern toilets utilize one of two types of fill valves to control the flush cycle of the toilet, either a float-type fill valve or a older ball-type fill valve. Most fill valves work similarly, and the two types differ mainly in the type of float used. The float-type fill valve has a cylindrical float that moves up and down a shaft, while the older ball-type utilizes a plastic ball approximately the size of a softball on the end of a long metal rod to operate the fill valve. U.S. Pat. No. 4,703,653 to Shoepe et al., entitled "Ballcock Float Structure" and assigned to Fluidmaster Inc. of Anahiem, Calif., illustrates a common fill valve employed in toilets and is incorporated herein by reference.

Toilet leaks can be caused by a number of factors. For example, leaks can be caused by a stuck or open flapper resulting from a bound-up chain connecting the toilet's flush handle to the flapper or by the flush handle getting stuck in the down position. Additionally, a damaged float taking on water, or a misaligned float, both of which may cause the fill valve to run slowly but continuously, can cause leaks.

One of the most common causes of leaks in toilets is a worn or warped flapper, which results in a "silent leak" that can often go undetected for long periods of time. Flappers may fail to provide a proper seal through normal wear and mineral buildup over time. Such wear is contributed to by an increasing level of chemicals added to municipal water systems to purify the water, as well in-tank cleaners.

Figure 1:
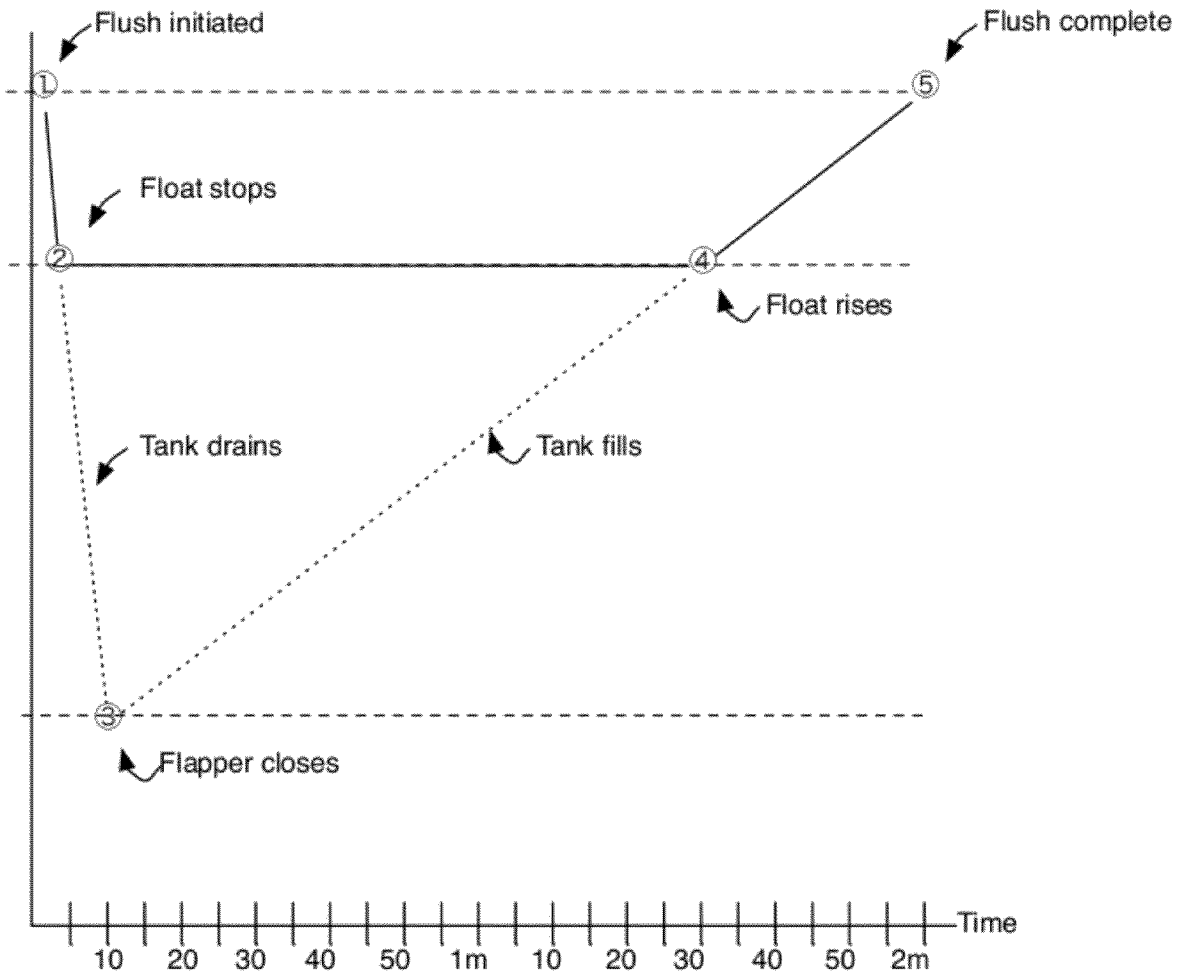
FIG. 1 is a diagram of a typical flush cycle.

FIG. 1 illustrates a normal flush cycle in a typical toilet. The flush cycle is illustrated in FIG. 1 as series of events labeled 1-5 plotted along a time axis showing the flush cycled as observed in one exemplary toilet; other cycles are of course possible in different toilets.

The flush cycle of FIG. 1 begins at marker 1, where the flush is initiated, typically by a user pulling on a lever that lifts the toilet flapper, causing water to drain from the tank. In some systems, a sensor may initiate the flush when the user leaves the proximity of the toilet.

As water drains from the tank, the float will descend until stopping at a lower-most point at marker 2. Meanwhile, water will continue draining from the tank until the flapper closes at marker 3. As will be appreciated from FIG. 1, the drain cycle happens very quickly, with the tank draining in 10-20 seconds.

When the flapper closes at marker 3, the tank begins to refill. When the water level reaches the float, the float will begin to rise along with the water surface at marker 4. When the water level reaches a point defined as the maximum fill level, the float mechanism closes the fill valve supplying water to the tank at marker 5, shutting off the water flow and finishing the flush cycle. As will also be appreciated from FIG. 1, the time to fill the tank takes significantly longer than the drain cycle, nearly two minutes in the example of FIG. 1. The time required to fill the tank will of course be dependent upon several variables, including tank size, type of fill valve used, and plumbing characteristics such as water pressure.

Figure 2:
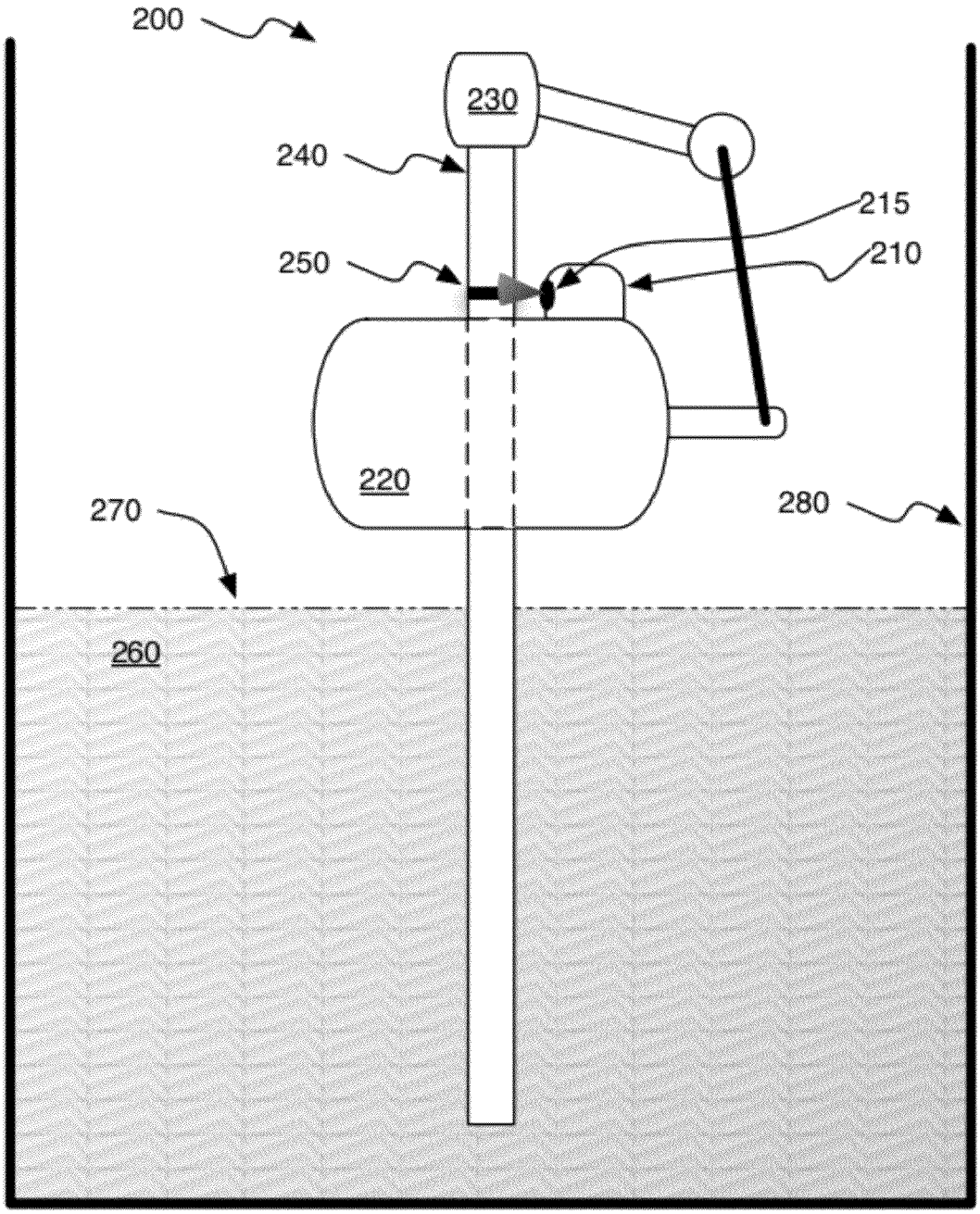
FIG. 2 is a conceptual diagram of an optical leak detection system in a toilet tank in accordance with the teachings of this disclosure.

FIG. 2 is a conceptual diagram of an optical leak detection system 200 in accordance with the teachings of this disclosure. FIG. 2 shows a conventional fill valve assembly 230 installed within a tank 280. A float 220 is shown mounted about a fill valve tube 240 of the fill valve assembly 230. The float 220 will rise and fall up and down the fill valve tube 240 according to the surface 270 of the water 260 that is contained in the tank 280.

The optical leak detection system 200 includes an optical detection module 210. The optical detection module 210 includes an IR LED emitter and photo-transistor detector 215 mounted in a housing and oriented such that axial directions of the light path coincide at a single point, preferably on a reflective target 250 defined on the fill valve tube 240.

FIG. 2 shows the optical detection module 210 enclosed in a separate housing that may be affixed to a pre-existing float. It is contemplated that the optical leak detection module may be housed within the float as well, thereby forming a single float/optical sensor module. The optical detection circuitry may be placed in any location such that the target may be sensed as the float rises and falls as will be explained more fully below.

In exemplary embodiments, the fill valve tube 240 may be darkened to provide a relatively low reflectivity. The reflective target 250 may comprise a highly reflective material affixed to the fill valve tube 240 at a location corresponding to a maximum water fill level in the tank 280, such as adhesive tape. Optical targets may be manufactured into the fill valve tube if desired.

It is contemplated that the reflective target may comprise material that may be removably affixed so as to provide a means to adjust the operation of the system, such as a wire-tie covered in highly reflective material. The use of a movable reflective target permits the maximum fill line to be adjusted as needed. It will be appreciated that a reflective tube may be employed in conjunction with an absorptive target.

As shown above, variations from a normal flush cycle can be characterized by a detected leak signature. Thus, in a leak situation, a different signal profile or signature will be generated from a normal flush cycle. The sensor modules of this disclosure preferably are configured to differentiate a normal flush signature from a leak signature and provide an appropriate alarm. A rapid change in volume should be recognized as a flush, and a slow change in volume should be detected as a leak.

It is contemplated that a signature may be determined through many different methods. For example, observing the derivative of the received signal can help provide a signature to analyze. Alternatively, counting the reflections sensed from an optical target as the float goes up and down can provide a signature, and timing how long a reflection or absorption is sensed can also help detect a leak.

It is contemplated that mechanical embodiments may be employed as well as electronic sensors. Mechanical means can be used to track the movement of the float, such as feeler gauges that will activate a switch to enable the signature detection. The disclosed system could use a rack and pinion configuration to detect the rotation of a sensor as the float traverses the fill valve tube during a flush cycle.

Mechanical means may be employed for determining whether a float has traversed an equal distance along the fill valve tube during a flush cycle. For example, a mechanical mechanism may be used to count an equal number of ticks going up and down, and then resets. If the count is not equal, and visual indicator may be engaged. Likewise, if there is one tick going down and not a return tick during a reasonable time period, an alarm may go off.

An ultra sonic detector may be placed within the tank to sense the changes in location of the water surface to detect leaks in accordance with this disclosure.

Figure 3:
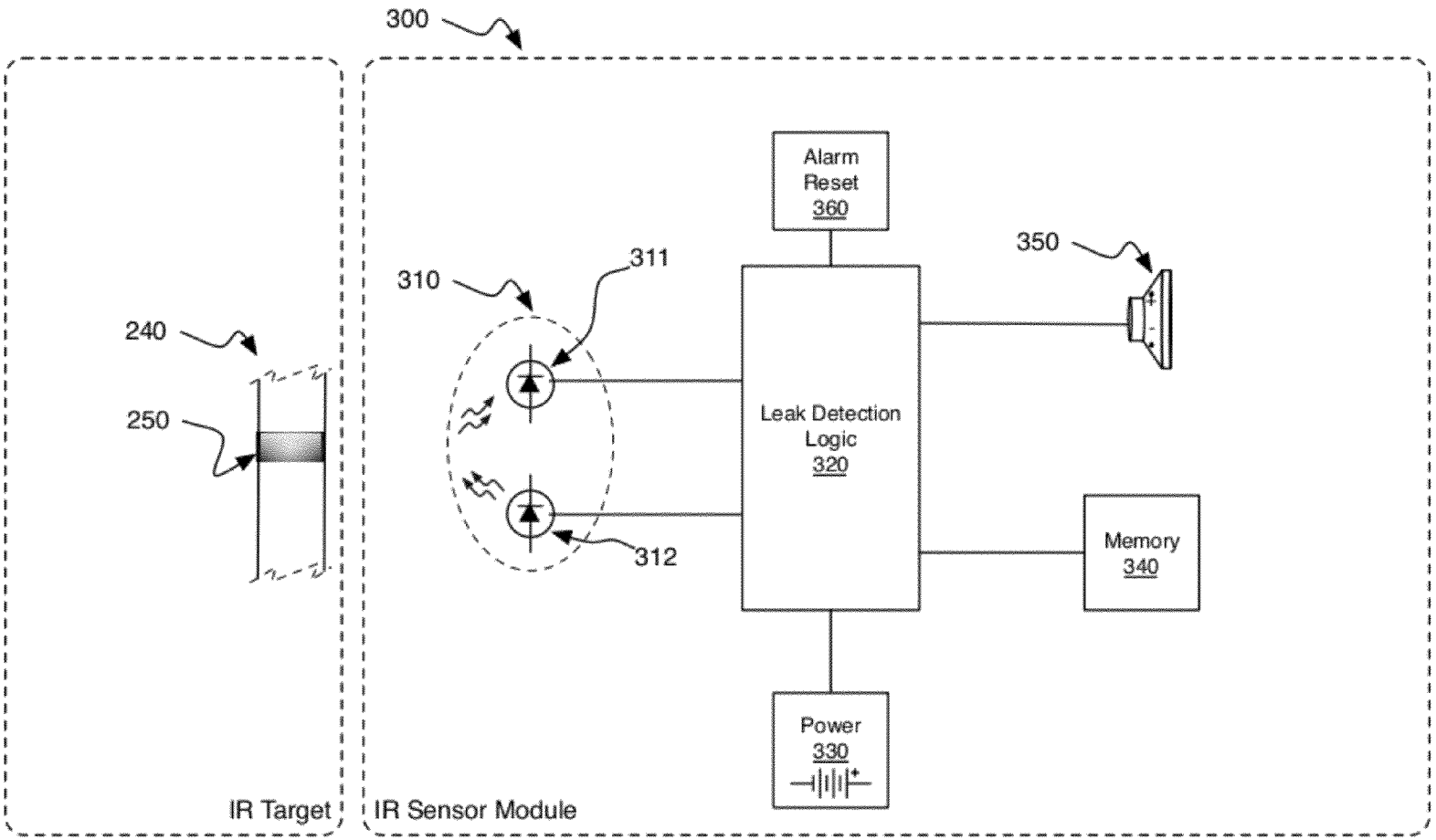
FIG. 3 is a conceptual block diagram of an optical leak detection module in accordance with the teachings of this disclosure.

FIG. 3 is a conceptual block diagram of an optical sensor module 300 in accordance with the teachings of this disclosure. The optical sensor module 300 includes an optical transceiver 310 for transmitting and receiving optical signals. The optical transceiver 310 is preferably oriented so as to send and receive optical signals to and from the fill valve tube 240 and optical target 250.

In one exemplary embodiment, the optical transceiver 310 may comprise a module such as a QRB1134 module available from Fairchild Semiconductor, or an equivalent. The optical transceiver 310 may integrate both a detector 311 and emitter 312 in small package.

The optical transceiver 310 may be electronically coupled to a leak detection logic module 320 for detecting leaks in accordance with this disclosure. It is contemplated that the leak detection logic module 320 may comprise a wide variety of logic implementations, such as a microcontroller, hard logic such as a finite state machine, or logic implemented through conventional analog circuitry.

The logic 320 is preferably configured to determine if the tank is ever in a non-full state outside of a flush cycle. As mentioned above, the water level in the toilet tank under goes cycles of draining and filling, whether by leakage or a flush. An exemplary leak detection algorithm corresponds to leak and flush cycles having differing lengths or periods. A cycle period is determined by the amount of time required for the float to drop below the maximum fill line and then return. The flush cycle is relatively rapid, requiring as little as 20 seconds to approximately a few minutes to complete. Slow leaks can have much longer periods. These detected periods may be utilized to characterize signatures in accordance with this disclosure.

The leak detection system of this embodiment measures drain-fill cycle periods and uses a threshold detector to make the leak determination. When the logic of FIG. 3 receives an interrupt indicating a drop from the maximally filled state (i.e., the float has lowered), it starts a timer. If the float fails to return to the maximum fill level before the timer expires then it will signal a leak has been detected. If the float returns to the maximum fill level in time, then the system assumes that it was a normal flush, and the timer resets awaiting the beginning of the next cycle.

Though an optical sensor is utilized in the present embodiment, it is to be understood that any sensor suitable for detecting and characterizing a signature may be employed in this disclosure. For example, an accelerometer may be employed to detect the movement of the water surface to detect leaks. The accelerometer may be affixed to a float to detect the movement of a float up and down the fill valve tube as the surface level changes of the monitored water, and provide signals to leak detection logic as disclosed herein. A leak signature may thus be detected in accordance with this disclosure.

Likewise, mechanical switches may be used with the leak detection logic to detect leak signatures in accordance with this disclosure. It is contemplated that any sensor may be employed that can be used to characterize a rapid drop in the surface level of a monitored fluid as a normal flush, and a relatively slow change in the surface level should be detected as a leak signature.

The optical sensor module 300 may also have an associated power source 330, and memory 340. The optical sensor module 300 may also include a leak indicator alarm 350, such as a light or audible alarm, and a reset 360 for resetting the optical sensor module 300 and clearing an alarm state and returning the system to a normal state. It is contemplated that dye may be released into the tank as a result of an alarm state being detected. It is also contemplated that the alarm 350 may be placed in the flush handle of the toilet, so as to be proximate and perhaps visible to a user of the toilet.

Figure 4A:
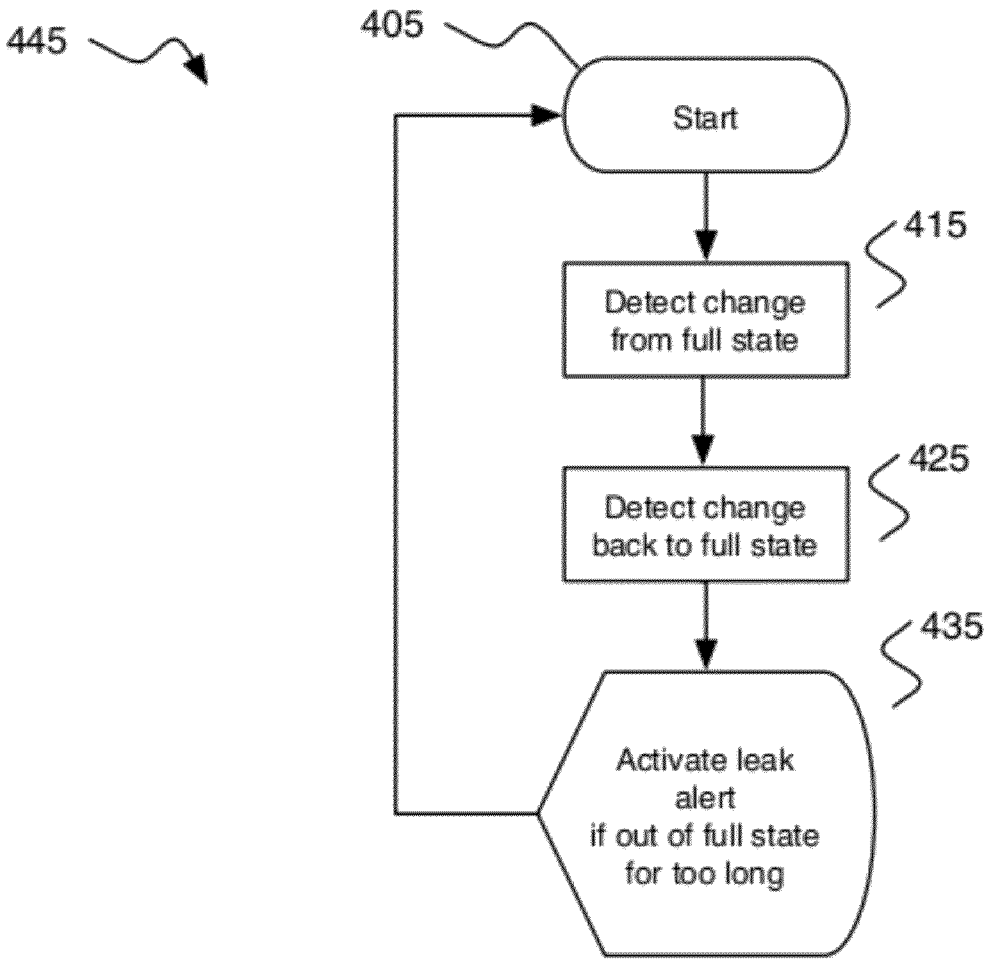
FIGS. 4A and 4B are flowcharts of exemplary methods for detecting leaks in accordance with the teachings of this disclosure.

FIG. 4A is a flow chart of one exemplary method for detecting leaks in accordance with this disclosure. The optical sensor system as shown and described above may perform the process of method 445. The process of FIG. 4A begins in act 405, where the system is in a steady state. The process then moves to act 415, where the system detects that the water level of the tank has changed states from a full state to a less-than-full state.

The process then moves to act 425, where the system detects that the tank has returned to a full state. Finally, in act 435, the system will provide an alert if the tank was in a less-than-full state for too long, indicating a possible leak.

Figure 4B:
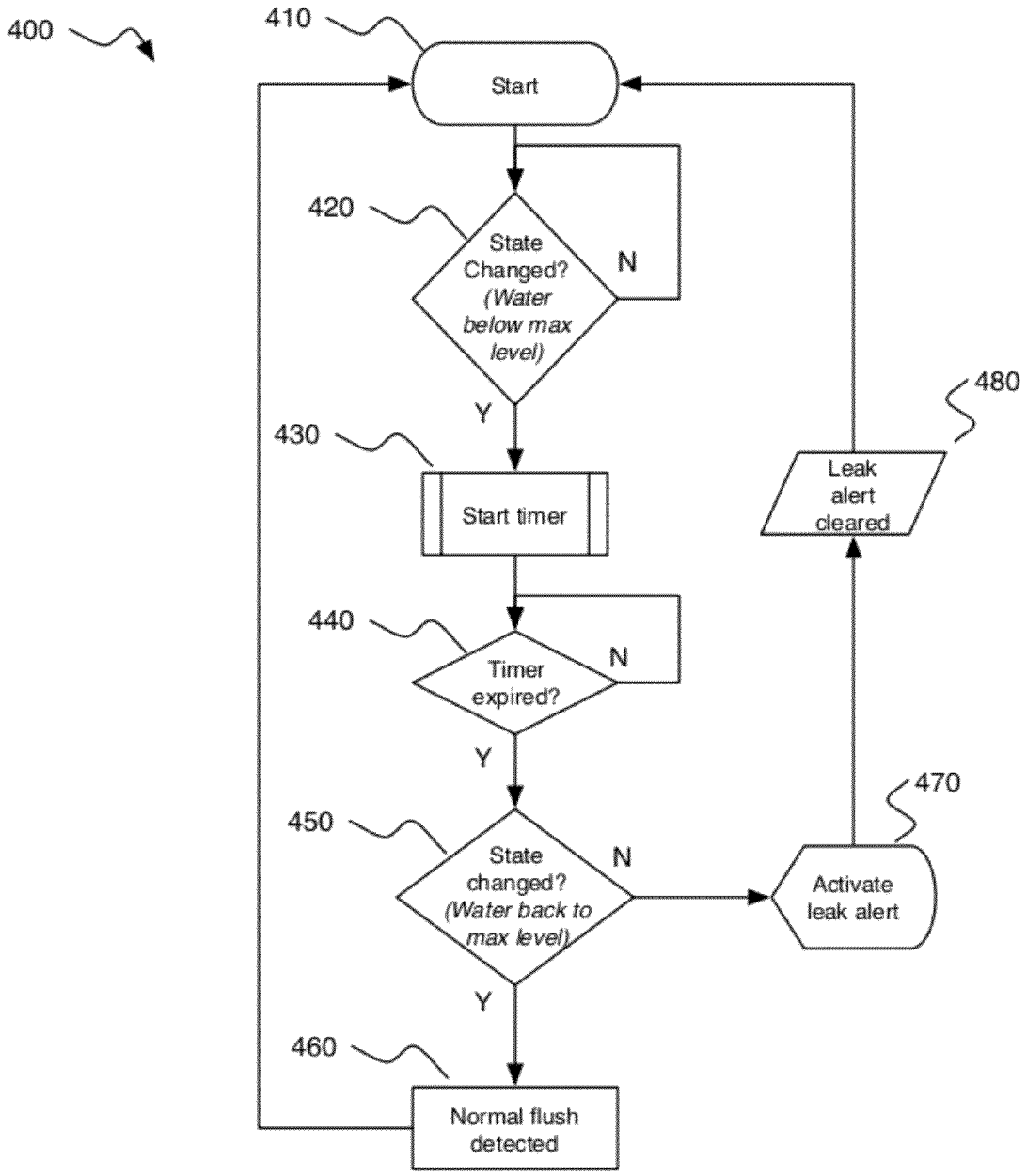

FIG. 4B is another flow chart of a method for detecting a leak in accordance with the teachings of this disclosure. The optical sensor system as shown and described above may perform the process of method 400. The method 400 begins in block 410, where the system is in a ready state.

The process then moves to query 420. In query 420, it is determined whether a state change has been sensed. In exemplary embodiments, the system may wait in query 420 until a state change has been sensed. In accordance with this disclosure, a state change may be represented by the optical sensor moving from a reflective area to an absorptive area (or visa versa) along the fill tube as the float moves up or down. The sensing of a state change may represent the optical sensor module 300 falling below a maximum water fill line as will be more fully described below. Once a state change has been sensed, the process moves from query 420 to block 430, where a timer is started.

The process then moves to query 440, where the process waits for the timer to expire. Once the timer has expired, the process then determines whether the state change has been sensed again in query 450. This act may correspond to determining whether the optical sensor module has returned to the maximum fill level within the period determined by the timer.

If the state change return has been sensed in query 450 within the timer's defined period, then it will be determined that a normal flush cycle has occurred in act 460, and the process returns to the ready state of act 410.

If the timer has expired and the state change has not been sensed in query 450, then the leak alarm is activated in act 470. Once the alarm has been cleared in act 480, the system then returns to the ready state of act 410.

Thus, in the above algorithm, one state has been assigned to represent the state of the tank being filled to a maximum capacity, and the other state representing the tank in a less-than-full state. In a normal flush cycle, the tank will return to a full state within a certain period of time. The present disclosure describes a system for monitoring the water volume of a tank to determine when the tank is in a less-than-full state for a period of time indicating a possible leak.

Figure 5A:
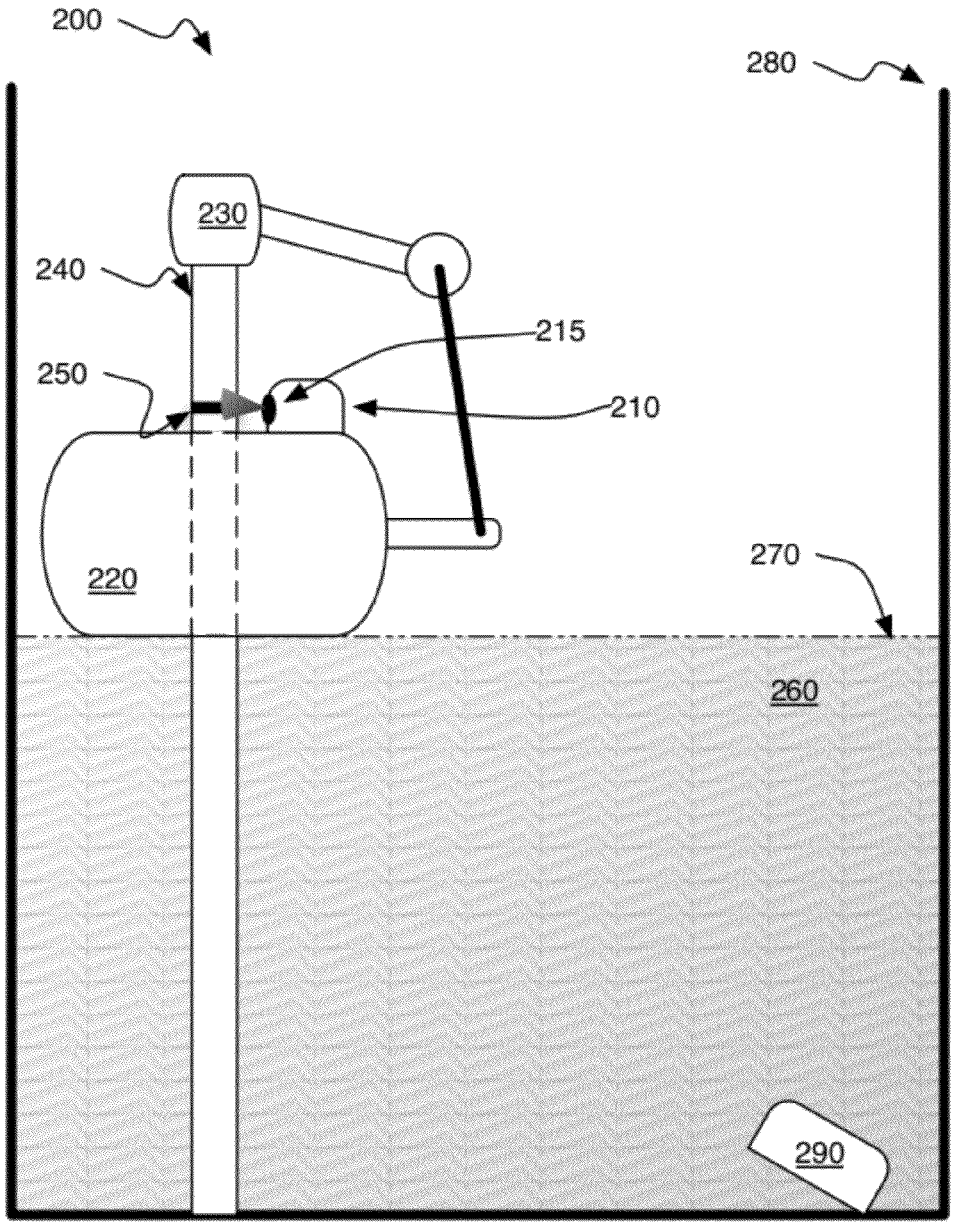
FIGS. 5A-5D are diagrams of a leak detection system in operation in accordance with the teachings of this disclosure.

FIG. 5A-5D represent conceptual diagrams of the operation of an optical leak detection system in accordance with the teachings of this disclosure. FIGS. 5A-5D illustrate the operation of the optical leak detection system as disclosed herein in a normal flush cycle. The process begins in FIG. 5A, where the system 200 is in a steady state. In FIG. 5A, the water level 270 in tank 280 is at a maximum fill level, such that the optical detector 215 in housing 210 is positioned adjacent to the optical target 250 on float 220. In this state, the reflective properties of the target 250 as sensed by the sensor module 210 represent a maximum fill state.

Figure 5B:
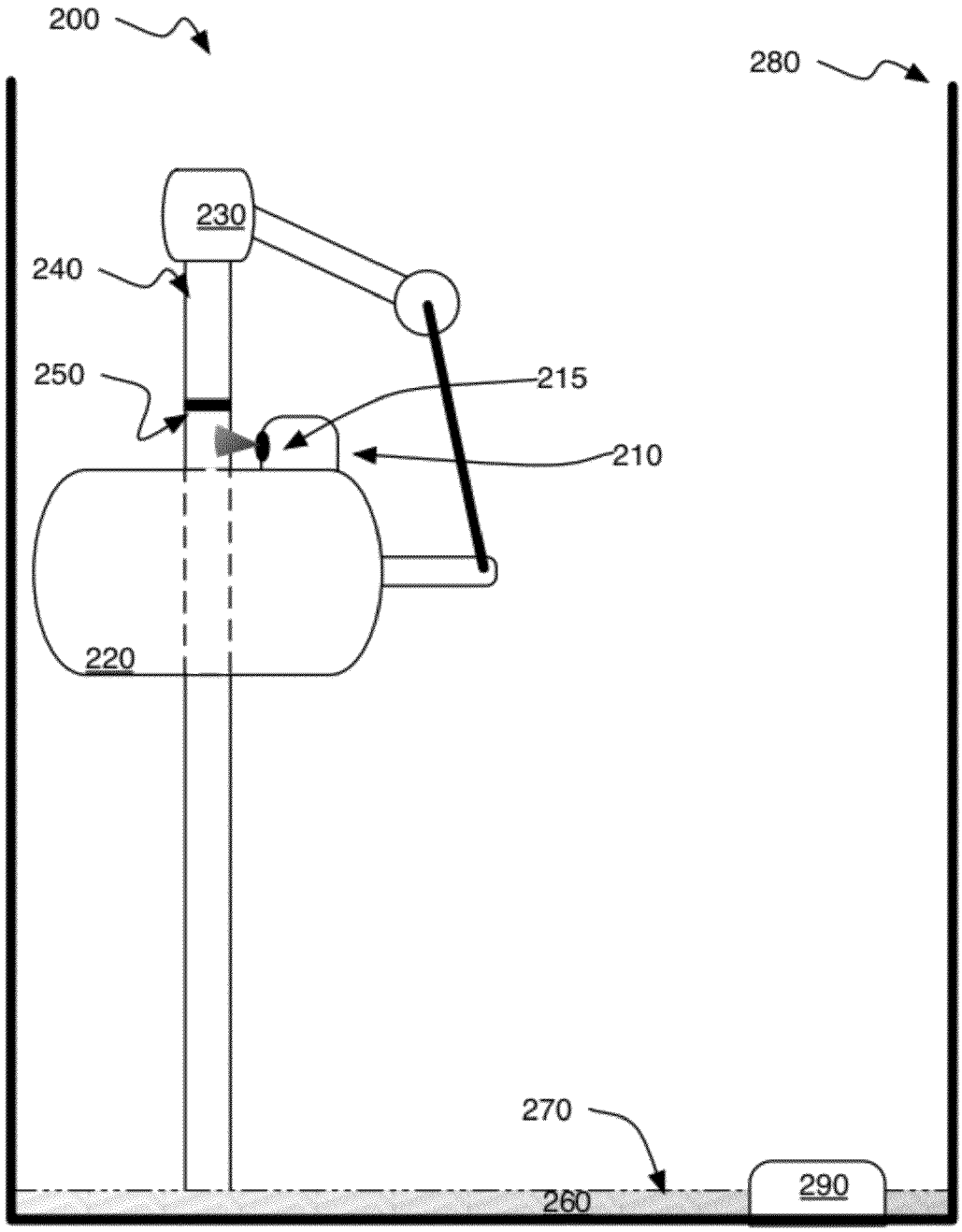

In FIG. 5B, a flush is initiated when the flapper 290 is opened, and water begins to flow out of the tank. In FIG. 5B, the tank 280 has emptied of water, and the float has reached a minimum level as determined by the float stop. The flapper 290 has closed, and water will begin to fill the tank 280.

Figure 5C:
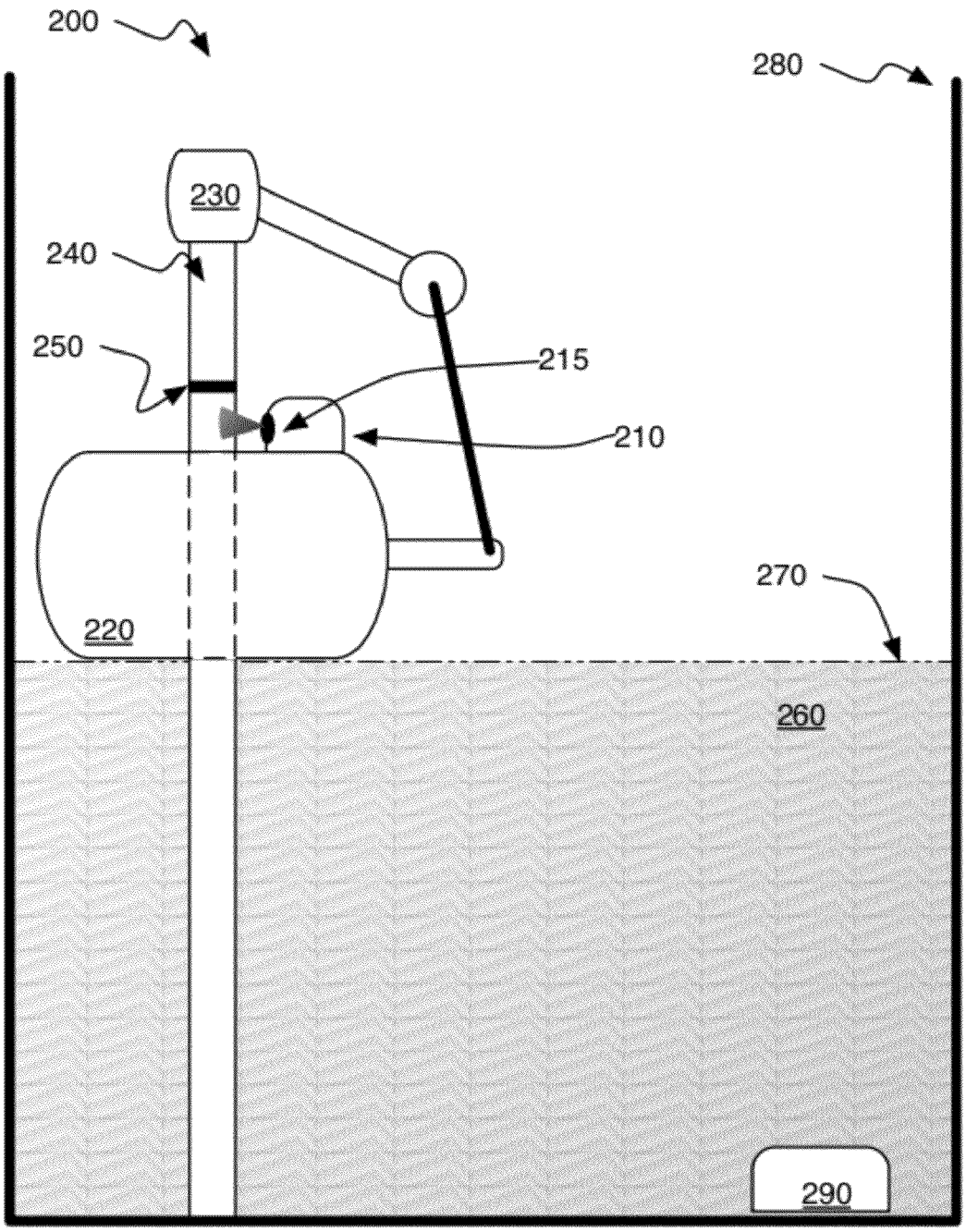

In FIG. 5B, the optical sensor 215 will detect the change a state as the sensor module 210 has passed below the optical target 250, and is now sensing the optical properties of the fill valve. As described above, a timer will be started as a result of a sensed change in state. In FIG. 5C, the water level continues to rise and the float begins to rise correspondingly. The timer continues to run.

Figure 5D:
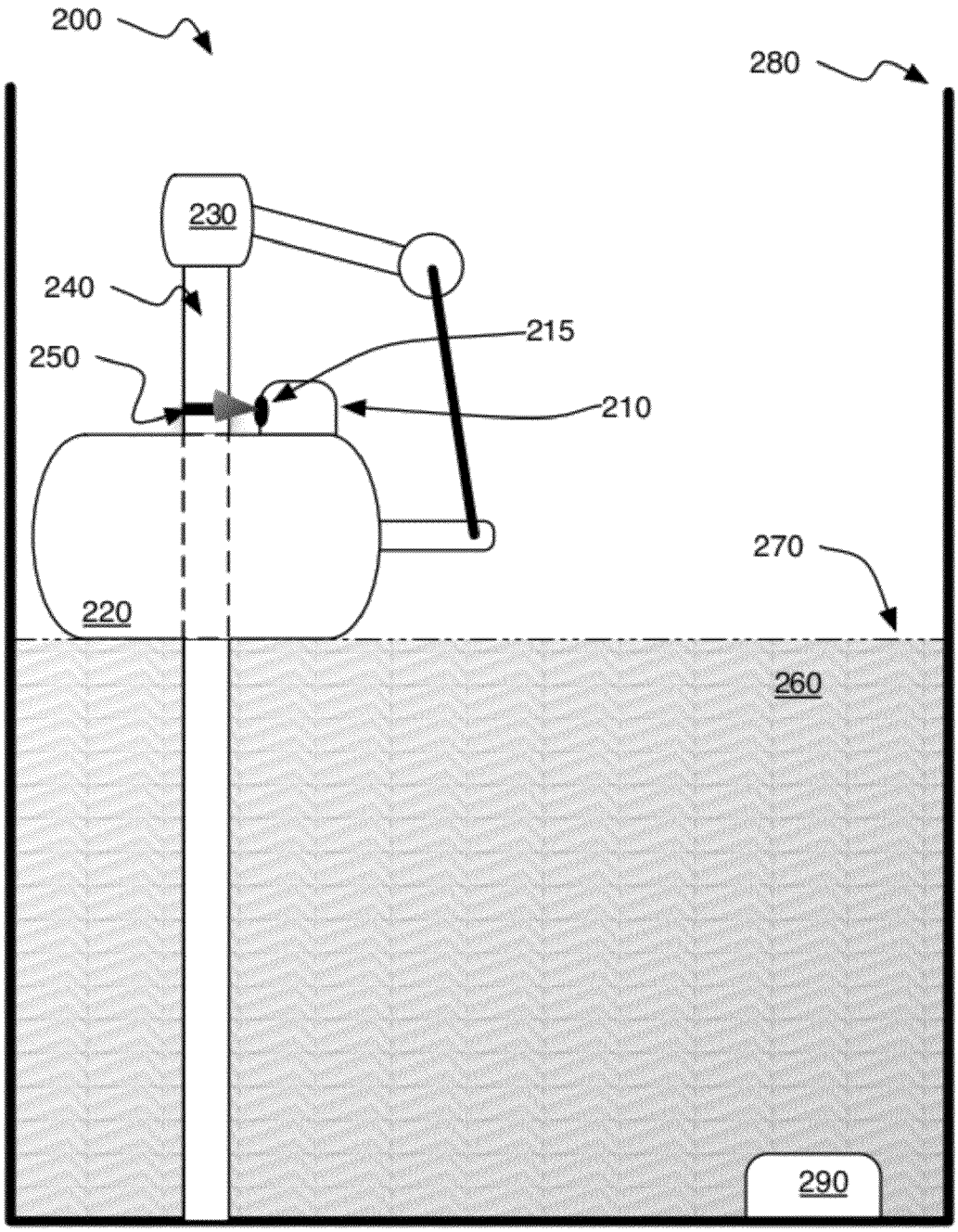

In FIG. 5D, the water level 270 reaches a maximum level and the sensor 215 once again senses the optical target 250, signaling a change in state. The water level 270 in the tank 280 has reached a maximum level, and the float 220 is back at a maximum upper location, with the sensor 215 adjacent to the optical target 250.

As will now be appreciated, if the water level has returned to a maximum fill level within the time period defined by the timer period, the cycle of FIGS. 5A-5D will be defined as normal, and no alarm will be activated as no leak has been detected.

It will be appreciated that the optical target 250 may have a length that may be optimized for each system. As fill valves tend to have some hysteresis in the on-off cycle, the length of the optical target 250 may be increased lengthwise along the fill tube to allow for a longer "full state" to provide some play to prevent false alarms when the actual full state of the tank varies from flush to flush.

As can now been appreciated, if a leak is present, the present leak detection system will detect variations in water level based upon the time signature defined by a normal leak cycle. For example, a leak may cause the water level to drop slowly, with the float lowering over an elongated period of time, perhaps rising and lowering through a cycle of several minutes or more. If the water level lowers and rises over a period of such length, the sensor of this disclosure will detect such a variance from the normal cycle, and sound an alarm. The user will then be alerted, and may clear the alarm using the reset mechanism, and be prompted to check the flush mechanism for sources of leaks, such as a faulty flapper and the like.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

We claim:

1. A leak detector for a tank configured to fill with, to contain, and to flush a fluid, the leak detector comprising:

an optical sensor configured to determine the level of the fluid in the tank;

a leak detection logic connected to the optical sensor and configured characterize a change in the fluid level in the tank as:

a normal flush, wherein the fluid level decreases from and returns to a maximum fluid level within a specified time period; and a leak, wherein the fluid level decreases from and does not return to a maximum fluid level within the specified time period;

wherein the leak detection logic is configured to account for inconsistencies in the fluid level at which the tank ceases filling, following a flush, by acknowledging a range of maximum fluid levels; and an alarm connected to the leak detection logic and configured to activate an alert when the leak detection logic characterizes a change in the level of the fluid as a leak.

2. The leak detector of claim 1, further comprising a timer configured to initiate when the fluid level in the tank is detected to drop below a maximum fluid level of the tank.

3. The leak detector of claim 2, wherein the timer is configured to stop when the fluid level in the tank returns to a maximum fluid level, and wherein the leak detection logic is configured to characterize the change in fluid level as:

a flush if the timer is stopped within the specified time period; and a leak if the timer is not stopped within the specified time period.

4. The leak detector of claim 2, wherein the timer is configured to expire at the end of the specified time period, and wherein, once the timer expires, the leak detection logic is configured to characterize the change in fluid level as:

a flush if the fluid level returns to a maximum fluid level before the timer expires; and a leak if the fluid level does not return to a maximum fluid level before the timer expires.

5. The leak detector of claim 1, wherein the leak detection logic is configured to acknowledge a range of maximum fluid levels to prevent false characterization of a fluid level change as a leak.

6. The leak detector of claim 1, wherein the alarm is configured to activate a visual alert to signal a leak in the tank.

7. The leak detector of claim 6, wherein the visual alert is a colored dye added to fluid in the tank.

8. The leak detector of claim 1, further comprising a reset mechanism, wherein the alert is cleared through the reset mechanism.

9. The leak detector of claim 1, wherein the optical sensor includes an optical emitter, an optical detector, and an optical target, wherein the optical target is configured to move, relative to the optical emitter and optical detector, with changes in the fluid level in the tank, and wherein the optical emitter and the optical detector cooperate to track the position of the optical target.

10. The leak detector of claim 9, wherein at least one of the optical detector and optical emitter is configured to couple to a float operably mounted about a fill valve tube of a fill valve assembly arranged substantially within the tank, wherein the float moves vertically with changes in the fluid level in the tank.

11. The leak detector of claim 9, wherein the optical target is configured to be adjustably affixed to a fill valve tube arranged within the tank, and wherein the optical target is adjustable to correspond with a maximum fluid level of the tank.

12. The leak detector of claim 9, wherein the optical target has a specified length, wherein the length of the optical target corresponds to the range of maximum fluid levels of the tank.

13. The leak detector of claim 9, wherein the optical target comprises an optically reflective material.

14. The leak detector of claim 13, wherein the optical sensor is configured to detect the fluid level in the tank to be at a maximum fluid level when optical signals are reflected off of the reflective surface of the optical target and toward the optical detector, and to detect the fluid level in the tank to be below a maximum fluid level when optical signals are absorbed by an absorptive area defined by a surface of a fill valve tube, arranged within the tank, as the float moves vertically according to the fluid level in the tank.

15. The leak detector of claim 9, wherein the optical emitter and optical detector form an optical transceiver.

16. A method for detecting leaks in a tank configured to contain and to flush a fluid, the method comprising:

monitoring a target that defines a range of maximum fluid levels in the tank;

accounting for inconsistencies in the fluid level at which the tank ceases filling, following a flush, by acknowledging a range of maximum fluid levels;

initiating a timer when the fluid level in the tank falls below a maximum fluid level;

characterizing the change in the fluid level in the tank as a leak if the fluid level does not return to a maximum fluid level within a specified time period;

characterizing the change in the fluid level in the tank as a flush if the fluid level returns to the maximum fluid level within the specified time period; and activating an alert if the change in the fluid level is characterized as a leak.

17. The method of claim 16, wherein monitoring the target includes monitoring an optical target of a specified length, wherein the length of the optical target corresponds to the range of maximum fluid levels of the tank.

18. The method of claim 17, wherein monitoring the optical target includes sensing a reflective material defined by the optical target and affixed to a fill valve tube arranged substantially within the tank, wherein detection of the reflective material indicates that the fluid in the tank is a maximum fluid level.

19. The method of claim 18, wherein characterizing the change in the fluid level in the tank as either of a flush and a leak includes transitioning from sensing the reflective material to sensing an absorptive material comprising the fill valve tube.

20. The method of claim 16, wherein activating the alert includes activating an audible alarm.

21. The method of claim 16, further comprising stopping the timer when the fluid level returns to a maximum fluid level, wherein characterizing the change in fluid level as a leak occurs if the timer is not stopped within the specified time period, and wherein characterizing the change in fluid level as a flush occurs if the timer is stopped within the specified time period.

22. The leak detector of claim 16, wherein the timer expires at the end of the specified time period, wherein characterizing the change in fluid level as a leak occurs if the fluid level does not return to a maximum level before the timer expires, and wherein characterizing the change in fluid level as a flush occurs if the fluid level does returns to a maximum level before the timer expires.

* * * * *